US007069675B2

(12) United States Patent
Nishi et al.

(10) Patent No.: US 7,069,675 B2
(45) Date of Patent: Jul. 4, 2006

(54) POWER TILT APPARATUS

(75) Inventors: Manabu Nishi, Saitama (JP); Shu Someya, Saitama (JP)

(73) Assignee: Showa Corporation, Saitama (JP)

( * ) Notice: Subject to any disclaimer, the term of this patent is extended or adjusted under 35 U.S.C. 154(b) by 333 days.

(21) Appl. No.: 10/655,934

(22) Filed: Sep. 5, 2003

(65) Prior Publication Data

US 2004/0187359 A1 Sep. 30, 2004

(30) Foreign Application Priority Data

Mar. 26, 2003 (JP) ..... 2003-086471

(51) Int. Cl.
*E02F 5/02* (2006.01)

(52) U.S. Cl. ..... 37/348; 37/236; 60/454

(58) Field of Classification Search ..... 37/234, 37/236, 414, 415, 348; 701/50; 172/2, 7, 172/4, 4.5; 60/454; 137/550
See application file for complete search history.

(56) References Cited

U.S. PATENT DOCUMENTS 3,618,897 A * 11/1971 Swoboda et al. ..... 254/270
3,643,824 A * 2/1972 Partridge ..... 414/492
3,770,325 A * 11/1973 Spence ..... 303/10
3,773,074 A * 11/1973 Miceli ..... 137/596
3,797,760 A * 3/1974 Davis et al. ..... 241/30
3,800,935 A * 4/1974 Montgomery ..... 198/572
3,811,579 A * 5/1974 Black ..... 414/347
3,831,683 A * 8/1974 Ikeda et al. ..... 172/4.5
3,930,776 A * 1/1976 Keller ..... 173/218
4,166,506 A * 9/1979 Tezuka et al. ..... 172/4.5
5,285,588 A * 2/1994 Niemela et al. ..... 37/234
5,361,519 A * 11/1994 Ciula et al. ..... 37/234
5,443,083 A * 8/1995 Gotthelf ..... 137/484.8
5,829,174 A * 11/1998 Hadler et al. ..... 37/234
2004/0149462 A1* 8/2004 Okamoto et al. ..... 172/292

FOREIGN PATENT DOCUMENTS

JP 7228297 8/1995

* cited by examiner

*Primary Examiner*—Thomas A Beach
(74) *Attorney, Agent, or Firm*—Orum & Roth LLC

(57) ABSTRACT

In a power tilt apparatus in which an operation state of a cylinder apparatus is switched between an extension side and a compression side in accordance with an oil feeding direction of a pump apparatus by a switching valve apparatus provided in a pipe passage connecting the cylinder apparatus and the pump apparatus, where a sintered body filter is provided in the middle of the pipe passage.

7 Claims, 10 Drawing Sheets

POWER TILT APPARATUS

BACKGROUND OF THE INVENTION

1. Field of the Invention

The present invention relates to a power tilt apparatus preferably used in a snowplow, ship propulsion machinery and the like.

2. Description of the Related Art

In the conventional snow plow and ship propulsion machinery, as described in Japanese Patent Application Laid-Open No. H7-228297 (patent document 1), a power tilt apparatus is disclosed in which an operation state of a cylinder apparatus is switched between an extension side and a compression side by a switching valve apparatus provided in a pipe passage connecting the cylinder apparatus and the pump apparatus, in accordance with an oil feeding direction of a pump apparatus.

In the conventional power tilt apparatus, a valve apparatus such as the switching valve apparatus, a manual valve apparatus or the like, a plug and the like provided in the pipe passage would be fixed so as to be screwed into a hole provided in a valve block. In a bored portion or a threaded portion of the valve block, foreign particles such as burrs or the like can not be completely removed by a washing process after the working process, so that the foreign particles occasionally are generated during screwing of the valve apparatus or the like. If the foreign particles are in the middle of the pipe passage, a malfunction of the valve apparatus is caused. In particular, in a compact valve apparatus, the possibility of malfunction is relatively high.

Accordingly, in the conventional power tilt apparatus, the pump apparatus is provided with a filter such as a mesh filter or the like.

The prior art has the following problems.

(1) Even in the case that the pump apparatus is provided with the filter, foreign particles are generated in the middle of the pipe passage and are caught on the filter only after they reach the tank. They are caught on the valve apparatus in the process of reaching the tank, and the malfunction is caused, particularly in the compact valve apparatus.

(2) In the case of the mesh filter, a frame for supporting the mesh is necessary, and an unintended disassembly prevention is also necessary. If the filter is downsized, an opening area of the filter is reduced by the frame or the like, and the filter is resultantly poor in strength and/or flow capacity. Accordingly, this structure is not adequate for a high pressure portion or a portion having a large flow rate.

SUMMARY OF THE INVENTION

An object of the present invention is to easily and securely attach a filter in the middle of a pipe passage in a power tilt apparatus, thereby securely protecting a valve apparatus or the like from foreign particles generated in the middle of the pipe passage.

In accordance with the invention, there is provided a power tilt apparatus in which an operation state of a cylinder apparatus is switched between an extension side and a compression side in accordance with an oil feeding direction of a pump apparatus. This is accomplished by a switching valve apparatus provided in a pipe passage connecting the cylinder apparatus and the pump apparatus. A sintered body filter is provided in the middle of the pipe passage.

BRIEF DESCRIPTION OF THE DRAWINGS

The present invention will be more fully understood from the detailed description given below and from the accompanying drawings which should not be taken to be a limitation of the invention, but are for explanation and understanding only.

The drawings.

DESCRIPTION OF THE PREFERRED EMBODIMENTS

Figure 1:
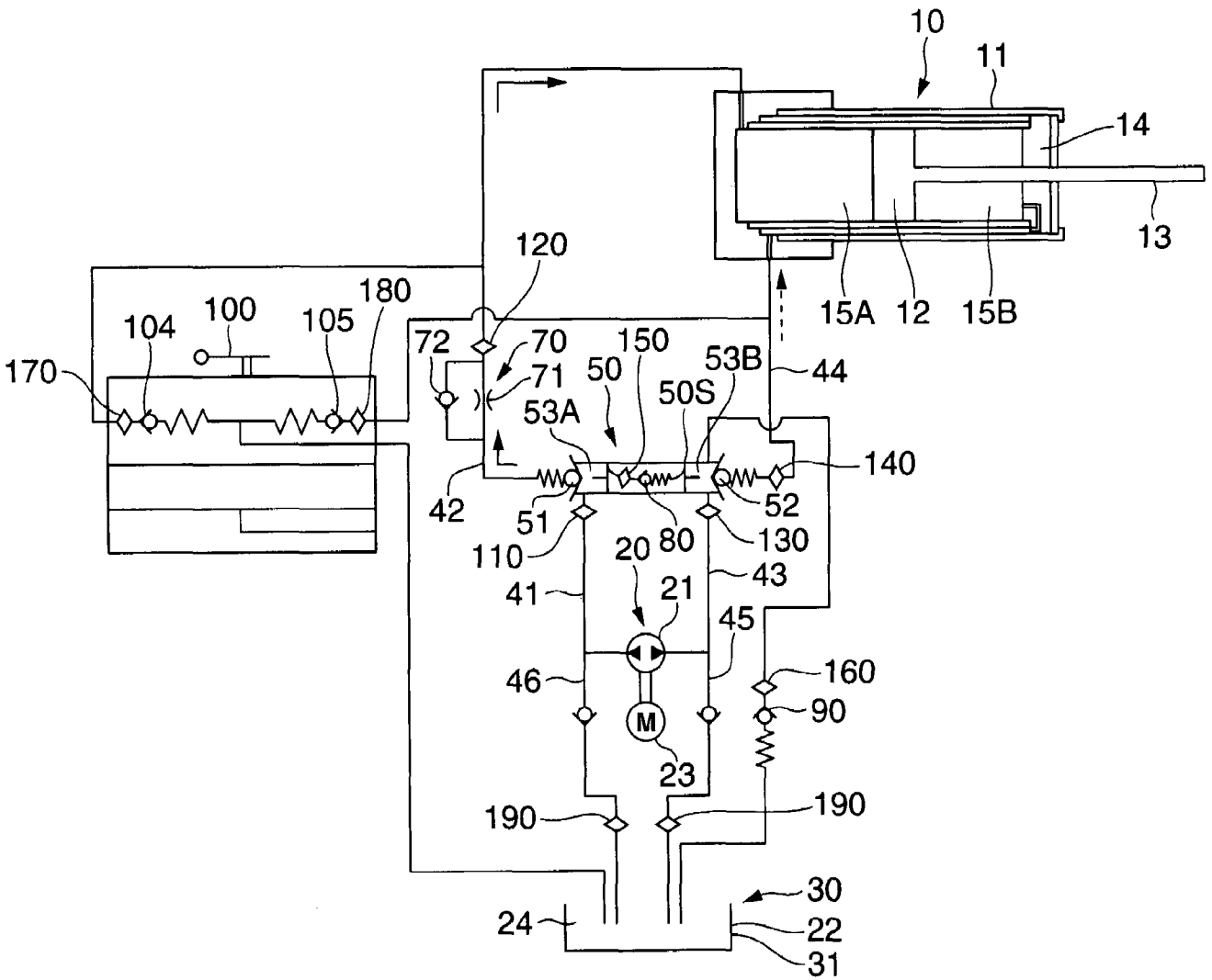
FIG. 1 is a hydraulic circuit diagram of a power tilt apparatus.

FIG. 1 shows a hydraulic circuit of a power tilt apparatus for a snow plow or the like. The hydraulic circuit is constituted by a hydraulic cylinder apparatus 10, a pump apparatus 20 and a tank apparatus 30. The hydraulic cylinder apparatus 10 (a cylinder 11), the pump apparatus 20 (a pump chamber 22) and the tank apparatus 30 (a tank case 31) are integrally formed in a valve block 40.

Figure 2:
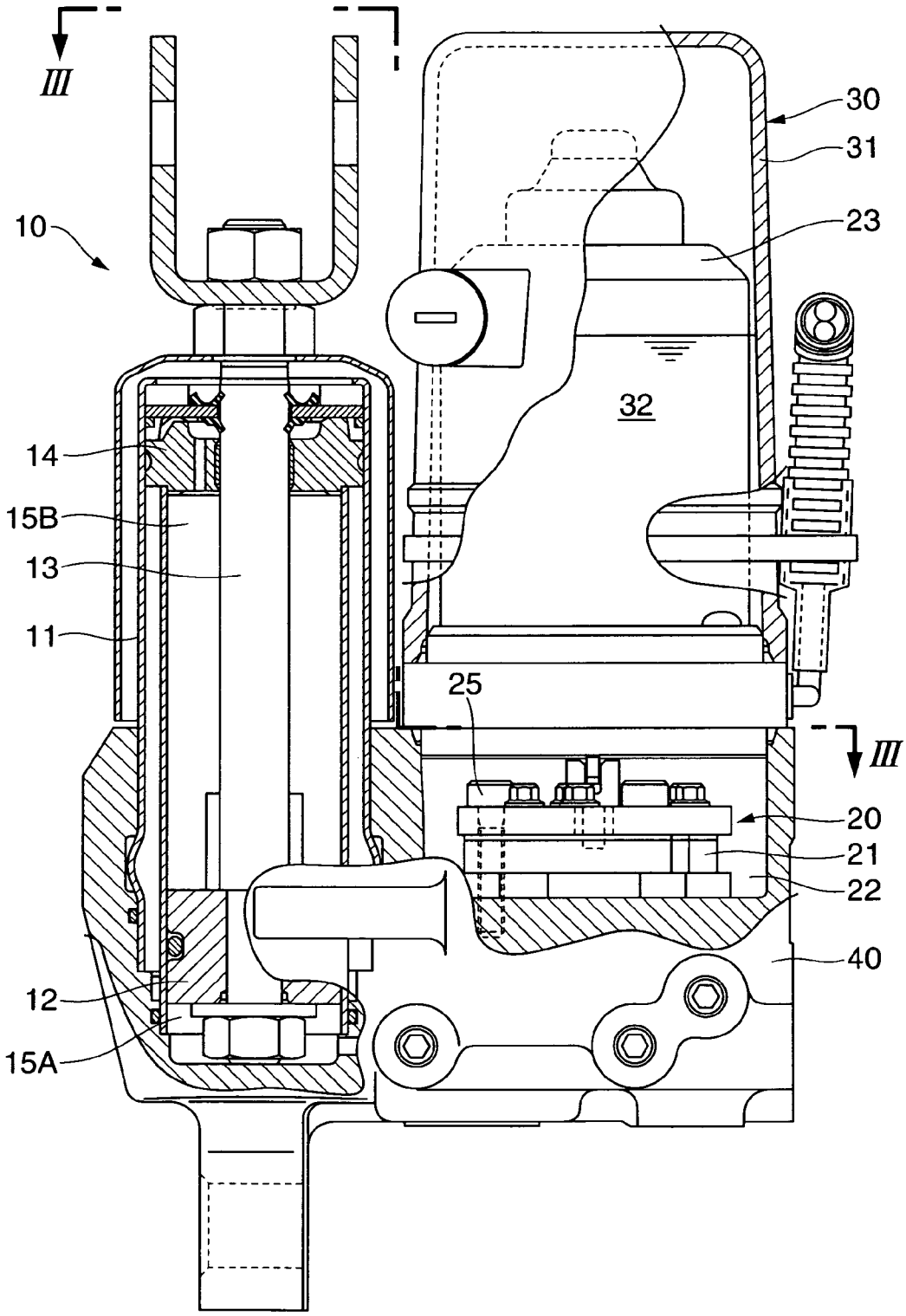
FIG. 2 is a front elevational view showing the power tilt apparatus in a partly broken manner.

The hydraulic cylinder apparatus 10 is structured, as shown in FIGS. 1 and 2, such that a piston 12 is slidably arranged in a cylinder 11, and a piston rod 13 connected to the piston 12 passes through a rod guide 14. An inner side of the cylinder 11 is separated into a lower chamber 15A and an upper chamber 15B by the piston 12. Further, working fluid is supplied from the pump apparatus 20 to the lower chamber 15A or the upper chamber 15B of the hydraulic cylinder apparatus 10, whereby the hydraulic cylinder apparatus 10 is extended and contracted. The piston rod 13 protrudes from the cylinder 11, whereby the hydraulic cylinder apparatus 10 is extended, or the piston rod 13 is received within the cylinder 11 so that the hydraulic cylinder apparatus 10 is contracted.

The pump apparatus 20 is structured such that the pump chamber 22 having a gear pump 21 received within the valve block 40 is formed, and a motor 23 rotating a gear pump 21 in a forward or backward direction is provided. The motor 23 is arranged so as to be fixed to an upper portion of the valve block 40. The tank case 31 of the tank apparatus 30 placed on a periphery of the motor 23 is arranged so as to be fixed to an upper portion of the valve block 40 in a periphery of the motor 23. An oil reservoir chamber 32 into which the motor 23 is dipped is formed in an inner portion of the tank case 31, and the oil reservoir chamber 32 is communicated with the pump chamber 22 disposed below the oil reservoir chamber 32. Further, a switching valve apparatus 50 mentioned below, and the like, are arranged within the valve block 40 corresponding to a valve casing.

Figure 3:
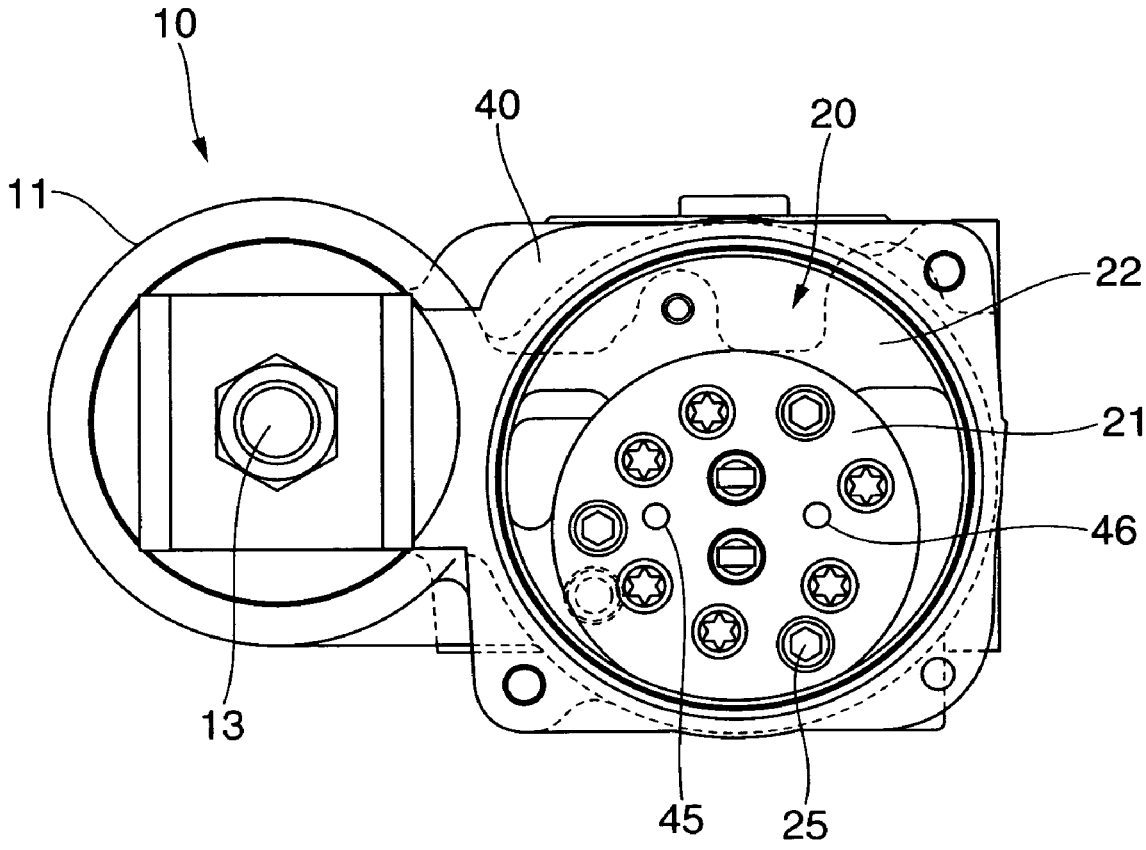
FIG. 3 is a view along a line III—III in FIG. 2.

The gear pump 21 of the pump apparatus 20, arranged in an inner portion of the pump chamber 22, as shown in FIGS. 1 and 3, is fixed to a bottom portion of the pump chamber 22 by a fixing bolt 25, and makes first and second suction ports 45 and 46 open to the pump chamber 22. The gear pump 21 is connected to the lower chamber 15A of the hydraulic cylinder apparatus 10 via a first lower chamber side flow passage 41, a lower chamber side poppet valve 51 of the switching valve apparatus 50 and a second lower chamber side flow passage 42. Further, the gear pump 21 is connected to the upper chamber 15B of the hydraulic cylinder apparatus 10 via a first upper chamber side flow passage 43, an upper chamber side poppet valve 52 of the switching valve apparatus 50 and a second upper chamber side flow passage 44. Further, the gear pump 21 communicates with the oil reservoir chamber 32 from the first suction port 45 and the second suction port 46 via the pump chamber 22.

Figure 4:
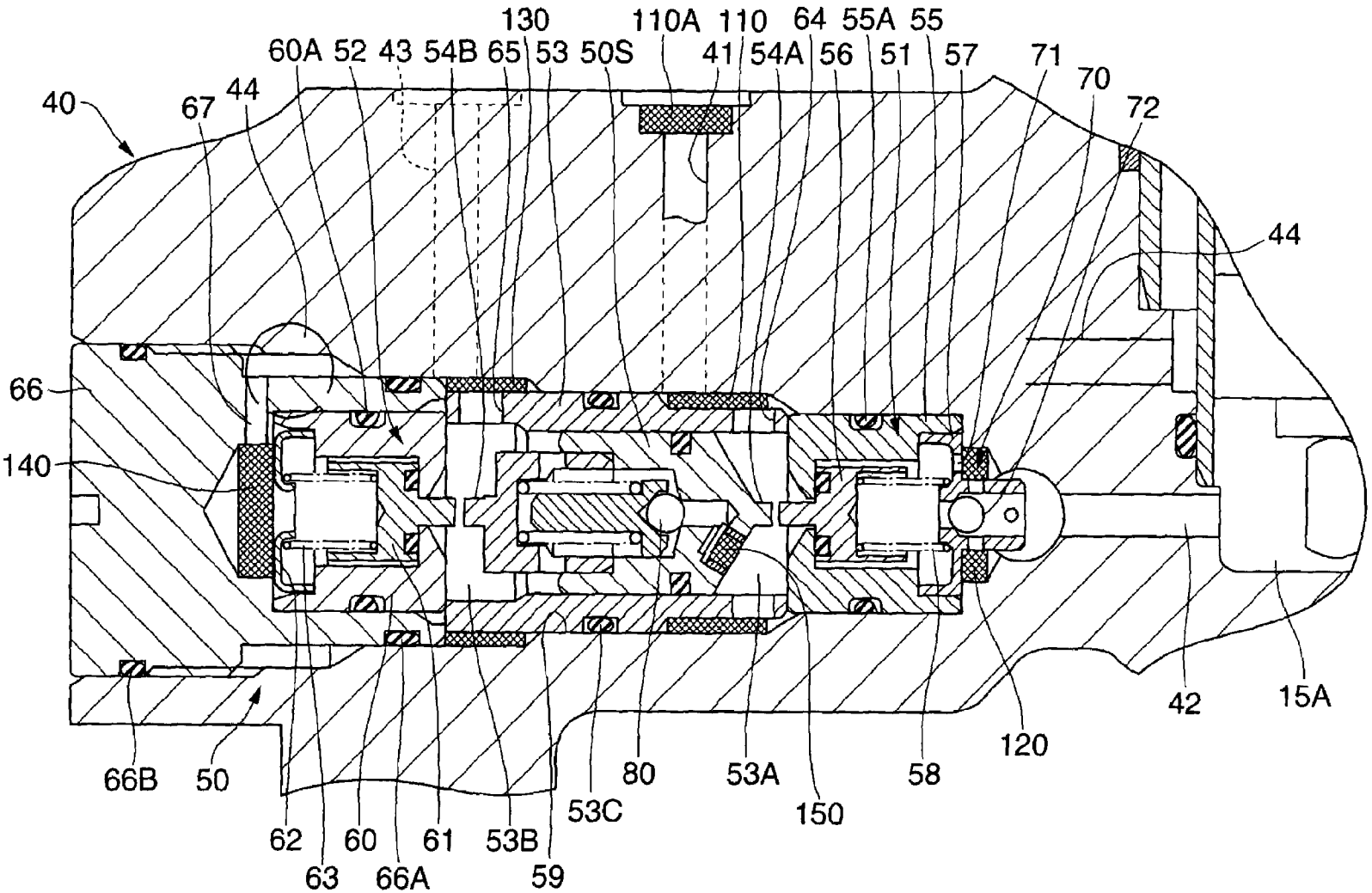
FIG. 4 is a cross sectional view showing a switching valve apparatus.

The switching valve apparatus 50 is provided with the lower chamber side poppet valve 51 corresponding to a first poppet valve and the upper chamber side poppet valve 52 corresponding to a second poppet valve in both sides of a spool 50S, respectively, as shown in FIGS. 1 and 4. The spool 50S is slidably received within a spool holder 53. Pressing portions 54A and 54B are provided in both end portions of the spool 50S in a protruding manner, respectively. The pressing portions 54A and 54B respectively press the lower chamber side poppet valve 51 and the upper chamber side poppet valve 52 so as to open the valves. The spool 50S forms a lower chamber side oil chamber 53A (a first shuttle chamber) and an upper chamber side oil chamber 53B (a second shuttle chamber) respectively between the spool 50S, and the lower chamber side poppet valve 51 and the upper chamber side poppet valve 52.

Accordingly, when the gear pump 21 rotates forward, the gear pump 21 introduces the working fluid within the oil reservoir chamber 32 of the tank apparatus 30 to an inner side of the lower chamber side oil chamber 53A of the switching valve apparatus 50 via the first suction port 45 and the first lower chamber side flow passage 41, as shown by a solid arrow in FIG. 1. The working fluid introduced within the lower chamber side oil chamber 53A opens the lower chamber side poppet valve 51, presses the spool 50S to a side of the upper chamber side oil chamber 53B, and opens the upper chamber side poppet valve 52 by the pressing portion 54B. In accordance with the valve opening of the lower chamber side poppet valve 51, the working fluid within the lower chamber side oil chamber 53A reaches the lower chamber 15A of the hydraulic cylinder apparatus 10 via the second lower chamber side flow passage 42, as shown by a solid arrow in FIG. 1. The working fluid in the upper chamber 15B is introduced to the gear pump 21 via the second upper chamber side flow passage 44, the upper chamber side poppet valve 52, in the valve open state, and the first upper chamber side flow passage 43. As a result, the piston 12 moves in a direction in which the piston rod 13 of the hydraulic cylinder apparatus 10 protrudes from the cylinder 11, and the hydraulic cylinder apparatus 10 is extended.

Further, when the gear pump 21 rotates in reverse, the gear pump 21 introduces the working fluid within the oil reservoir chamber 32 to the upper chamber side oil chamber 53B of the switching valve apparatus 50 via the second suction port 46 and the first upper chamber side flow passage 43, as shown by a broken arrow in FIG. 1. The working fluid introduced within the upper chamber side oil chamber 53B opens the upper chamber side poppet valve 52, moves the spool 50S toward the lower chamber side oil chamber 53A, and puts the lower chamber side poppet valve 51 in an open valve state by the pressing portion 54A. The working fluid within the upper chamber side oil chamber 53B reaches the upper chamber 15B of the hydraulic cylinder apparatus 10 via the second upper chamber side flow passage 44, as shown by a broken arrow in FIG. 1. The working fluid in the lower chamber 15A is returned to the gear pump 21 via the second lower chamber side flow passage 42, the lower chamber side poppet valve 51, in the valve open state, and the first lower chamber side flow passage 41. As a result, the piston 12 moves in a direction in which the piston rod 13 is received within the cylinder 11, and the hydraulic cylinder apparatus 10 is contracted.

In this case, the lower chamber side poppet valve 51 of the switching valve apparatus 50 is structured such that the lower chamber side valve body 56 is slidably arranged within the lower chamber side valve case 55 corresponding to a first valve case. The lower chamber side valve body 56 is energized by a spring 58 supported by a spring clamp 57 so as to be freely opened and closed. The spring clamp 57 is press fit into a fitting portion of the valve case 55 by an outer diameter. The lower chamber side valve body 56, the spring clamp 57 and the spring 58 are built in the lower chamber side valve case 55 so as to be formed as a cartridge, and are detachably received within a valve storing hole 59 in the valve block 40. At this time, an O-ring 55A attached to an outer periphery of the valve case 55 liquid seals the valve storing hole 59 between the first lower chamber side flow passage 41 and the second lower chamber side flow passage 42.

The upper chamber side check valve 52 of the switching valve apparatus 50 is structured, in the same manner as that of the lower chamber side check valve 51, such that the upper chamber side valve body 61 is slidably arranged within the upper chamber side valve case 60 corresponding to a second valve case. The upper chamber side valve body 61 is energized by a spring 63 supported by a spring receiver 62 so as to be freely opened and closed. The upper chamber side valve body 61, the spring clamp 62 and the spring 63 are built in the upper chamber side valve case 60 so as to be formed as a cartridge, and are detachably received within a plug 66 mentioned below screwed into the valve storing hole 59 in the valve block 40. An O-ring 60A attached to an outer periphery of the valve case 60 liquid seals the valve storing hole 59 between the first upper chamber side flow passage 43 and the second upper chamber side flow passage 44.

The spool 50S of the switching valve apparatus 50 is slidably arranged within the spool holder 53 so as to be made as the cartridge, as mentioned above, and is detachably received within the valve storing hole 59 of the valve block 40. At this time, the O-ring 53C attached to the outer periphery of the spool holder 53 liquid seals the valve storing hole 59 between the first lower chamber side flow passage 41 and the first upper chamber side flow passage 43, and between the first upper chamber side flow passage 43 and the second upper chamber side flow passage 44. Further, a lower chamber side communication passage 64 communicating the lower chamber side oil chamber 53A with the first lower chamber side flow passage 41 is formed in the spool holder 53. An upper chamber side communication passage 65 communicating the upper chamber side oil chamber 39B with the first upper chamber side flow passage 43 is formed there.

In the switching valve apparatus 50, the lower chamber side valve case 55, the spool holder 53 and the upper chamber side valve case 60 are held in a pressurized state within the valve storing hole 59. This is done by fitting the lower chamber side poppet valve 51 formed as the cartridge with the lower chamber side valve case 55, the upper chamber side poppet valve 52 formed as the cartridge with the upper chamber side valve case 60, and the spool 50S formed as the cartridge with the spool holder 53 adjacent to each other into the valve storing hole 59 from the opening portion of the valve storing hole 59 in the valve block 40. A plug 66 is screwed into the opening portion of the valve storing hole 59. O-rings 66A and 66B attached to the outer periphery of the plug 66 liquid seal the valve storing hole 59 between the first upper chamber side flow passage 43 and the second upper chamber side flow passage 44, and in an outer side of the second upper chamber side flow passage 44. Further, a plug communication passage 67 communicating the upper chamber side poppet valve 52 with the second upper chamber side flow passage 44 is formed in the plug 66.

Accordingly, in the hydraulic cylinder apparatus 10, a control valve 70 structured by arranging an orifice 71 parallel to a check valve 72 is interposed in the flow passage 42 connecting the lower chamber 15A of the cylinder 11 to the switching valve apparatus 50. It is thereby possible to throttle only the oil flow in a direction in which the cylinder apparatus 10 performs a contraction motion.

Figure 5:
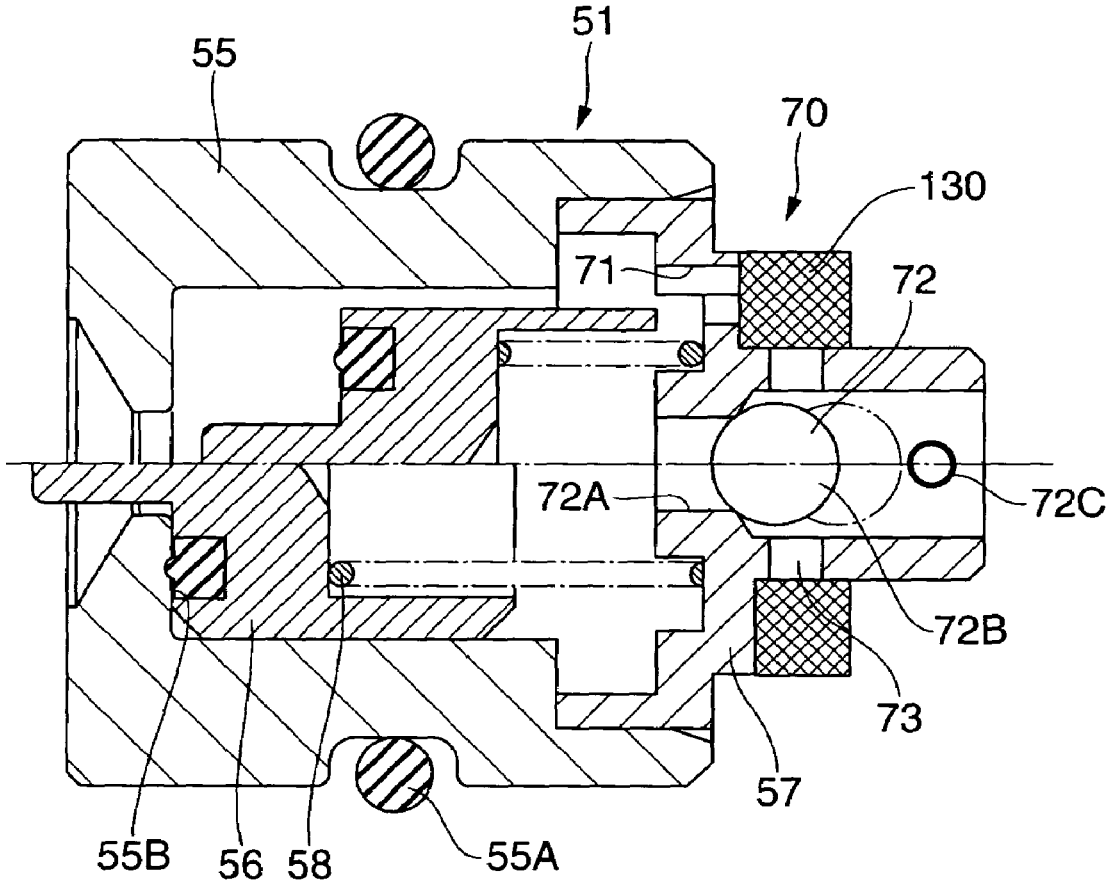
FIG. 5 is a cross sectional view showing a control valve.

The control valve 70 is integrally assembled and arranged in the valve case 55 of the lower chamber side poppet valve 51 comprising the switching valve apparatus 50, as shown in FIGS. 4 and 5. The poppet valve 51 is structured by slidably receiving the valve body 56 in the valve case 55, and fixing the spring receiver 57 to the valve case 55 so as to pressure insert while supporting the spring 58 pressing the valve body 56 against the valve seat 55B provided in the valve case 55 by the spring receiver 57 on a back surface, as mentioned above. The control valve 70 is integrally assembled in the spring receiver 57. The spring receiver 57 is provided with an orifice 71 in a side portion with respect to a center, and is provided with a flow passage 72A of a check valve 72 in the center. The orifice 71 and the flow passage 72A are arranged in parallel, and a ball 72B is arranged in the flow passage 72A. Further, a pin 72C for preventing the ball 72B from coming off is arranged so as to cross thereto. Reference numeral 73 denotes a flow passage.

The hydraulic cylinder apparatus 10 is operated as follows owing to the existence of the control valve 70.

(1) When the oil feeding direction of the pump apparatus 20 is defined by the forward rotation of the gear pump 21, the switching valve apparatus 50 switches the working state of the hydraulic cylinder apparatus 10 to the extension side, and pressure feeds the working fluid to the lower chamber 15A from the lower chamber side poppet valve 51. At this time, the check valve 72 of the control valve 70 is opened, the orifice 71 is not operated, and the hydraulic cylinder apparatus 10 is smoothly extended.

(2) When the oil feeding direction of the pump apparatus 20 is defined by the reverse rotation of the gear pump 21, the switching valve apparatus 50 switches the working state of the hydraulic cylinder apparatus 10 to the contraction side, and returns the working fluid to the lower chamber side poppet valve 51 from the lower chamber 15A. At this time, the check valve 72 of the control valve 70 is closed, and the orifice 71 is operated, so that oil from the hydraulic cylinder apparatus 10 is limited by the orifice 71. The hydraulic cylinder apparatus 10 is slowly contracted at a speed corresponding to a load.

(3) With respect to the opening and closing motion of the lower chamber side poppet valve 51 in the switching valve apparatus 50, pressure in the lower chamber 15A is applied to the poppet valve 51 via the orifice 71. Accordingly, the poppet valve 51 carries out a chattering motion due to the pressure of the lower chamber 15A. Thus, it is possible to prevent shaking.

In the hydraulic circuit of the power tilt apparatus shown in FIG. 1, an up-blow valve 80 is arranged in the lower chamber side oil chamber 53A of the switching valve apparatus 50. A down-blow valve 90 is connected to the upper chamber side oil chamber 53B of the switching valve apparatus 50. A manual and thermal valve 100 is connected to a communication passage communicating the second lower chamber side flow passage 42 with the second upper chamber side flow passage 44. The up-blow valve 80, the down-blow valve 90 and the manual and thermal valve 100 are arranged within the valve block 40 together with the switching valve apparatus 50.

The up-blow valve 80 is built in the spool 50S of the switching valve apparatus 50 in the same manner as that of Japanese Patent Application Laid-Open No. 2000-46208, as shown in FIG. 4. The up-blow valve 80 pressure inserts the pressing portion 54B mentioned above into the spool 50S, as shown in FIGS. 4 and 6, and is provided with a ball valve 82 in an opening and closing port 81A of a relief flow passage 81 provided in the spool 50S. The ball valve 82 is pressed in a direction of closing the opening and closing port 81A by a spring seat 84 energized and supported by a spring 83 backed up by the pressing portion 54B. The up-blow valve 80 returns the oil discharged to the first lower chamber side flow passage 41 by the gear pump 21 to the first upper chamber side flow passage 43 via the upper chamber side oil chamber 53B where the gear pump 21 continues forward rotation even when the piston 12 is brought into contact with the rod guide 14 during extension of the hydraulic cylinder apparatus 10.

Figure 7:
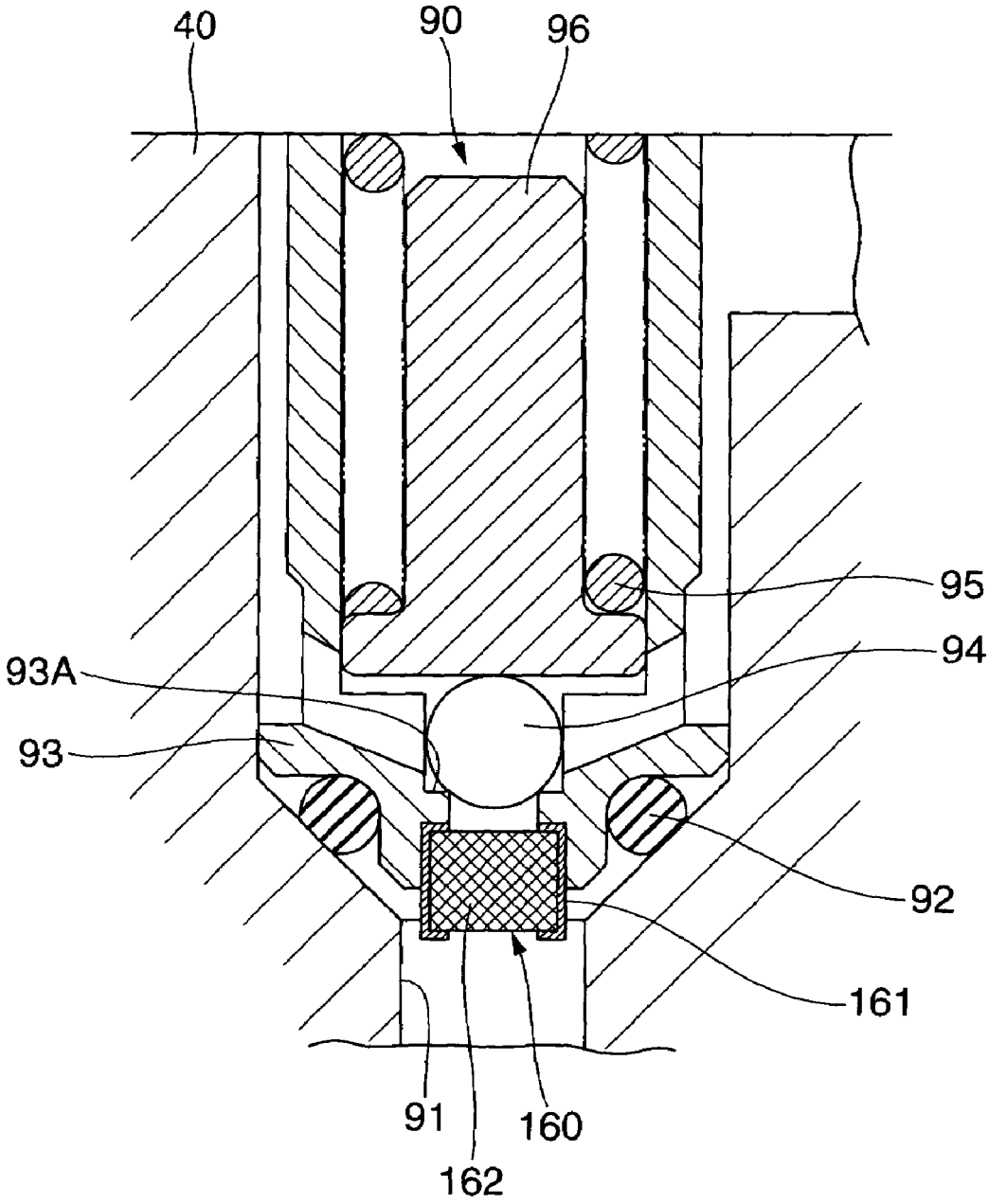
FIG. 7 is a cross sectional view showing a down-blow valve.

The down-blow valve 90 is provided in a relief flow passage 91 communicating the upper chamber side oil chamber 53B of the switching valve apparatus 50 with the pump chamber 22, within the valve block 40, in the same manner as that of Japanese Patent Application Laid-Open No. H11-278386, as shown in FIG. 7. The down-blow valve 90 utilizes a valve seat 93 arranged in the communication port of the relief flow passage 91 with the pump chamber 22 via an O-ring 92 set by the gear pump 21 fixed to the bottom portion of the pump chamber 22, and is provided with a ball valve 94 in an opening and closing port 93A of the relief flow passage 91 in the valve seat 93. The ball valve 94 is pressed in a direction to close the opening and closing port 93A by a spring seat 96 supported in an energizing manner by a spring 95 backed up by the gear pump 21. The down-blow valve 90 returns the working fluid in an amount corresponding to a volume of the piston rod 13 making an intrusion into the cylinder 11 to the pump chamber 22 via the upper chamber side oil chamber 53B, when the hydraulic cylinder apparatus 10 is contracted.

Figure 8:
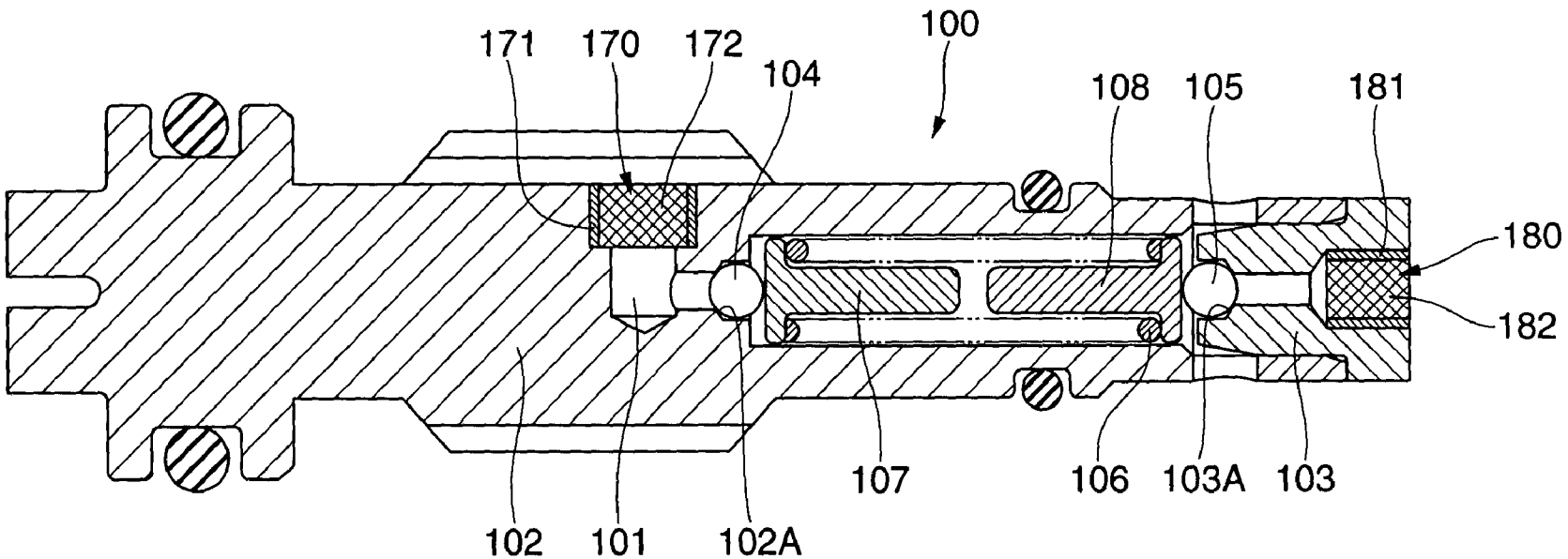
FIG. 8 is a cross sectional view showing a manual valve.

The manual and thermal valve 100 forms a bypass flow passage 101 connecting the second lower chamber side flow passage 42 to the second upper chamber side flow passage 44, bypassing the cylinder 11 in valve seats 102 and 103 which are press-inserted to each other so as to be integrated, as shown in FIG. 8. Ball valves 104 and 105 are provided in taper-shaped opening and closing ports 102A and 103A of the bypass flow passage 101 in the valve seats 102 and 103. The ball valves 104 and 105 are pressed in a direction to close the opening and closing ports 102A and 103A by both side spring seats 107 and 108 energized to both outer sides by a spring 106.

The ball valves 104 and 105 of the manual and thermal valve 100 releases circuit pressure to the pump chamber 22 from the oil reservoir chamber 32 on the basis of a set pressure, when an abnormal pressure increase is generated by the heat of the working fluid in the hydraulic cylinder apparatus 10 due to the temperature change. The manual and thermal valve 100 makes the working fluid within the lower chamber 15A and the upper chamber 15B of the hydraulic cylinder apparatus 10 communicate with the pump chamber 22 via the oil reserving chamber 32, in accordance with a manual opening operation performed by the operator, thereby manually extending and contracting.

Accordingly, in the hydraulic circuit of the power tilt apparatus in FIG. 1, to protect the valve apparatus or the like from the foreign particles generated in the middle of the pipe passage, the following structure is provided.

(A) Protection of Switching Valve Apparatus 50 and Control Valve 70 (FIGS. 4 and 5).

As shown in FIG. 4, in the switching valve apparatus 50, an annular sintered body filter 110, which may be a sintered porous body, is loaded in an annular gap between an inner peripheral surface to which the first lower chamber side flow passage 41 in the valve storing hole 59 is open, and an outer peripheral surface to which the lower chamber side communication passage 64 of the spool holder 53 is open.

As shown in FIGS. 4 and 5, in the switching valve apparatus 50, an annular sintered body filter 120 is loaded in an annular gap between an inner peripheral surface to which the second lower chamber side flow passage 42 in the valve storing hole 59 is open, and an outer surface to which the orifice 71 and the flow passage 73 of the control valve 70 in the spring clamp 57 of the lower chamber side poppet valve 51 is open.

As shown in FIG. 4, in the switching valve apparatus 50, an annular sintered body filter 130 is loaded in an annular gap between an inner periphery to which the first upper chamber side flow passage 43 in the valve storing hole 59 is open, and an outer periphery to which the upper chamber side communication passage 65 of the spool holder 53 is open.

As shown in FIG. 4, in the switching valve apparatus 50, a sheet-like sintered body filter 40 is loaded in a recess portion between a recess surface with which the second upper chamber side flow passage 44 is communicated via the plug communication passage 67 of the plug 66, and an outer periphery of the spring receiver 62 of the upper chamber side poppet valve 52.

In this case, the sintered body filters 110 to 140 may be inserted and fixed to the middle of the pipe passages constituted by the flow passages 41 to 44. For example, the sintered body filter 110 may be replaced by a sheet-like sintered body filter 110A provided in a connection port of the first lower chamber side flow passage 41 to the gear pump 21, as shown in FIG. 4. The sintered body filter 110A may be additionally used.

Figure 6:
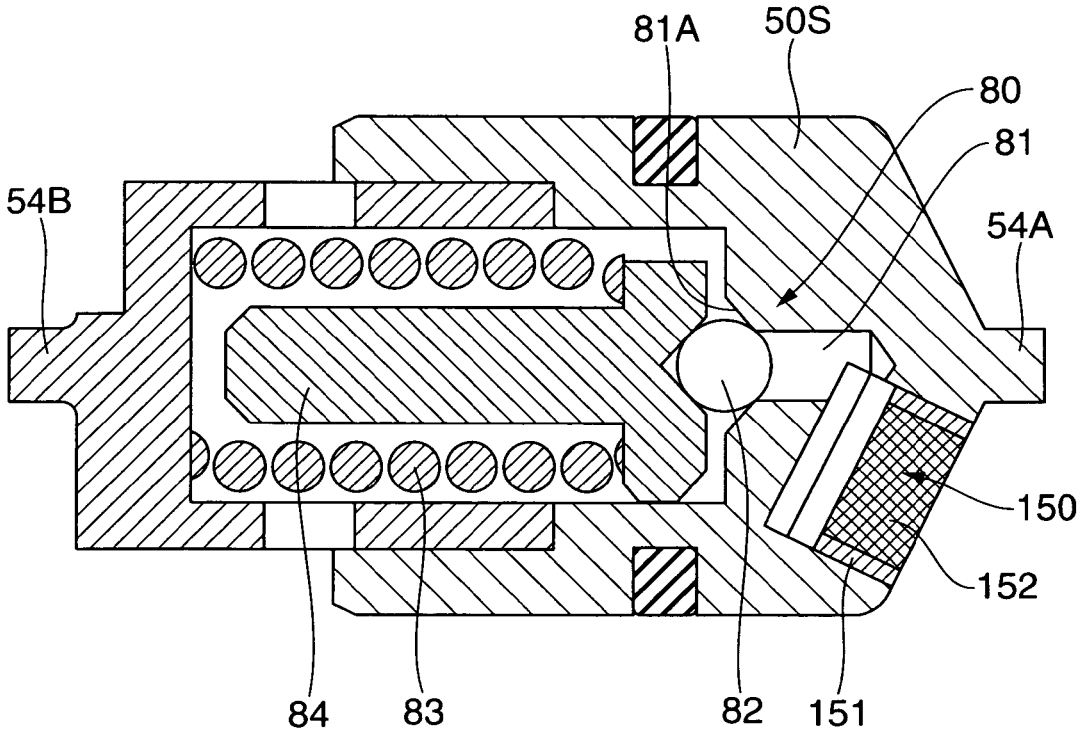
FIG. 6 is a cross sectional view showing an up-blow valve.

(B) Protection of Up-blow Valve 80 (FIGS. 4 and 6).

As shown in FIGS. 4 and 6, in the up-blow valve 80 built in the spool 50S of the switching valve apparatus 50, a rod-shaped sintered body filter 150 is loaded in a hole-shaped opening portion of the relief flow passage 81 provided in the spool 50S to the lower chamber side oil chamber 53A.

(C) Protection of Down-blow Valve 90 (FIG. 7).

As shown in FIG. 7, in the down-blow valve 90, a rod-shaped sintered body filter 160 is loaded in a hole-shaped communication portion with the relief flow passage 91 provided in the valve seat 93.

(D) Protection of Manual and Thermal Valve 100 (FIG. 8).

As shown in FIG. 8, in the manual and thermal valve 100, rod-shaped sintered body filters 170 and 180 are loaded in hole-shaped communication portions with the second lower chamber side flow passage 42 and the second upper chamber side flow passage 44 provided in the valve seats 102 and 103.

(E) Protection of Gear Pump 21

Figure 9A:
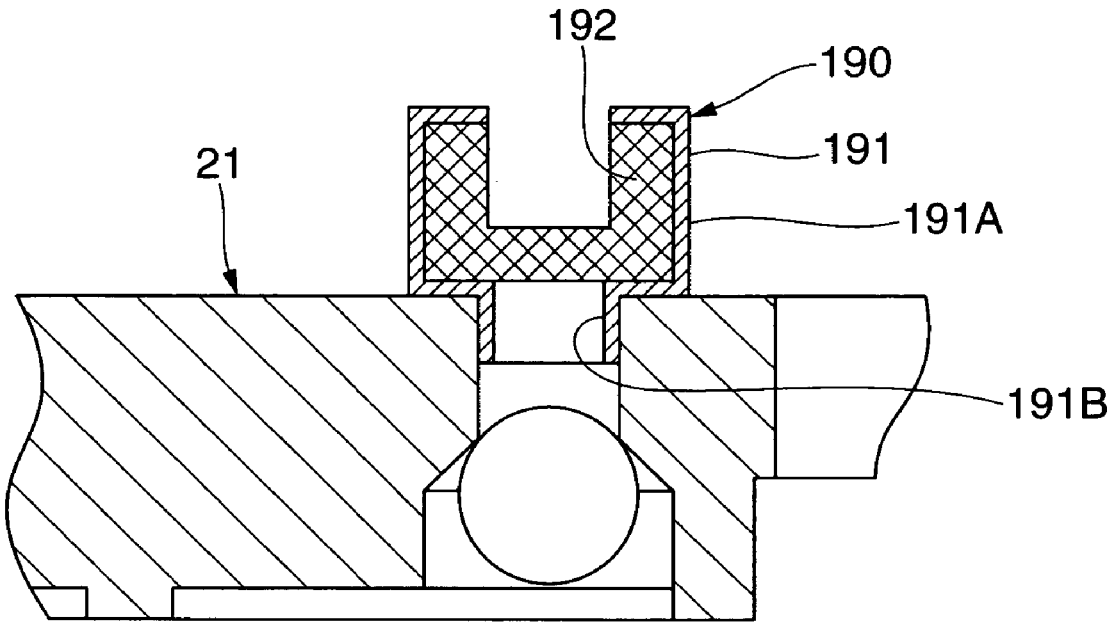
FIGS. 9A and 9B are cross sectional views showing a suction port of a pump apparatus.
Figure 9B:
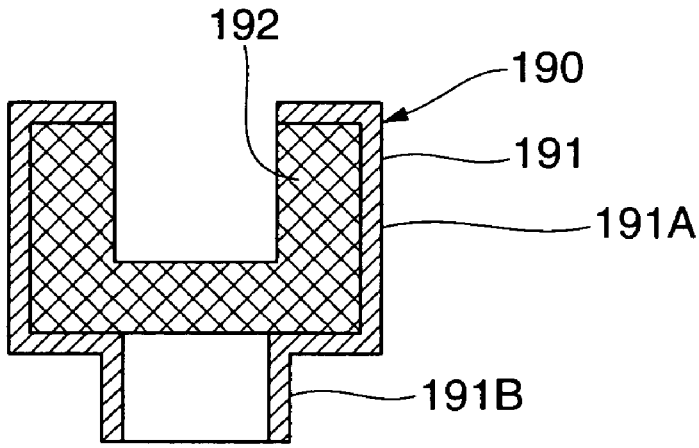

As shown in FIGS. 9A and 9B, in the gear pump 21, a sintered body filter 190 is loaded in each of the hole-shaped opening portions of the suction ports 45 and 46 open to the pump chamber 22.

The sintered body filters 110 to 190 may be comprised only of a filter main body, and may be loaded in the annular gap, the recess portion, the hole-shaped opening portion and the hole-shaped communication portion to be loaded.

The sintered body filters 110 to 190 may be formed by fitting a filter main body to a hollow portion of an annular body made of a pipe material such as a steel pipe, a copper pipe, a stainless steel pipe or the like, as described in the following items (1) to (3).

Figure 10A:
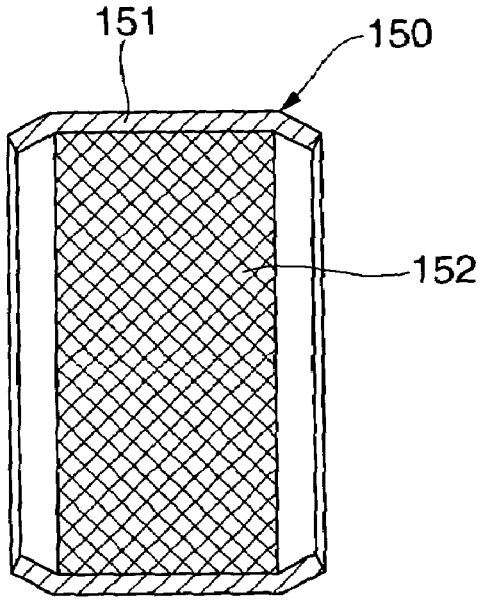
FIG. 10A is a cross sectional view showing a sintered body filter and FIG. 10B is an end elevational view showing a sintered body filter.
Figure 10B:
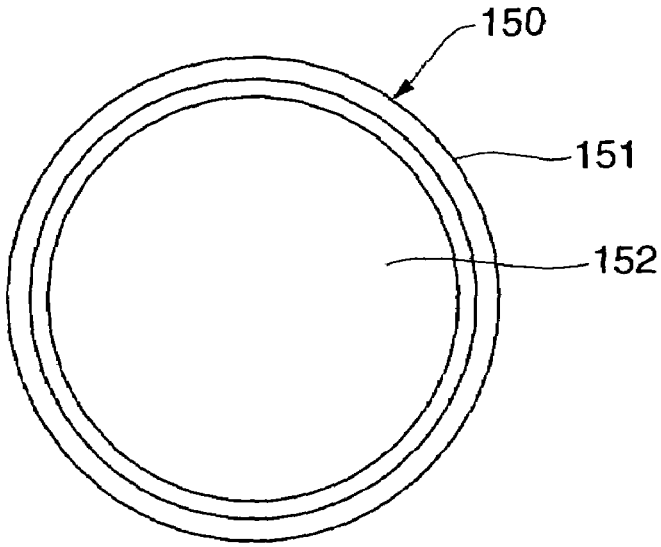

(1) In order to protect the up-blow valve 80, the rod-shaped sintered body filter 150 loaded in the hole-shaped opening portion of the relief flow passage 81 provided in the spool 50S is structured as follows. A filter main body 152 is fixed to an inner portion of a ring body 151 so as to be prevented from coming off, by fitting the filter main body 152 to a hollow portion of the ring body 151 and caulking both end portions of the ring body 151 to inner diameter sides, as shown in FIGS. 6, 10A and 10B.

The sintered body filter 150 can be prevented from coming off from the hole-shaped opening portion only by press-insertion of the ring body 151 to the hole-shaped opening portion of the relief flow passage 81 provided in the spool 50S.

(2) In order to protect the down-blow valve 90, the rod-shaped sintered body filter 160 loaded in the hole-shaped communication portion provided in the valve seat 93 is structured as follows. A filter main body 162 is fixed to an inner portion of a ring body 161 so as to be prevented from coming off, by fitting the filter main body 162 to a hollow portion of the ring body 161 and caulking both end portions of the ring body 161 to inner diameter sides, as shown in FIG. 7.

The sintered body filter 160 can be prevented from coming off from the hole-shaped communication portion only by press-insertion of the ring body 161 to the hole-shaped communication portion provided in the valve seat 93.

In this case, in the sintered body filters 170 and 180, filter main bodies 172 and 182 can be fitted to hollow portions of ring bodies 171 and 181, in the same manner as that of the sintered body filters 150 and 160.

(3) In order to protect the gear pump 21, the sintered body filter 190 loaded in the hole-shaped opening portion of the suction ports 45 and 46 of the gear pump 21 is structured as follows. A filter main body 192 is fixed to an inner portion of a large-diameter ring body 191A in a ring body 191 comprising the large-diameter ring portion 191A and a small-diameter ring portion 191B so as to be prevented from coming off, by fitting the filter main body 192 to a hollow portion of the large-diameter ring body 191A and caulking an outer end portion of the large-diameter ring body 191 to an inner diameter side, as shown in FIGS. 9A and 9B. In this case, the filter main body 192 is formed in a closed-end tubular shape, and a wetted surface area thereof is enlarged in comparison with the filter main body having a solid columnar shape.

The sintered body filter 190 can be prevented from coming off from the hole-shaped communication portion only by press-insertion of the small-diameter ring body 191B to the hole-shaped opening portions of the suction ports 45 and 46.

In this case, the sintered body filters 110 to 190 may be structured such that the filter main body is inserted to the hole-shaped gap, the recess portion, the hole-shaped opening portion or the hole-shaped communication portion to be loaded. A disassembly prevention cover is provided in an insertion opening so as to be fixed thereto.

The sintered body filters 110 to 190 may comprise any one of a synthetic resin sintered body filter, for example, a resin sintered body filter as described in Japanese Patent Application Laid-Open No. H11-347323, a metal sintered body filter, for example, a resin sintered body filter as described in Japanese Patent Application Laid-Open No. 2002-126426, and a ceramic sintered body filter. However, it is preferable to apply the sintered body filter made of metal or made of ceramic to a loaded portion having a large pressure or a large flow amount.

The sintered body filters 110 to 190 can be three-dimensionally molded as the sintered body filters are different from the mesh filter, and are mechanically strong. Accordingly, since only disassembly prevention is necessary, it is possible to secure a large area in the opening portion and it is possible to make the structure compact. Since the sintered body filters 110 to 190 can be optionally formed, can be made compact, and can be easily prevented from coming off, it is possible to easily and directly load them to the middle of the pipe passage of the power tilt apparatus and the valve apparatus. In particular, the sintered body filters 110 to 190 can be built in the spool 50S so as to be made compact, whereby it is possible to protect the relief valve such as the up-blow valve 80 from foreign particles. Further, since it is possible to apply the common filter to any pipe passage or any valve apparatus because of the compact structure, it is possible to easily change to the valve structure with the filter having a high compatibility.

In accordance with the present embodiment, the following operations and effects can be obtained.

(1) Since the sintered body filters 110 to 190 are loaded in the middle of the pipe passage, it is possible to catch foreign particles generated in the middle of the pipe passage by the sintered body filters 110 to 190 in the middle of the pipe passage, whereby it is possible to securely protect the valve apparatus and the like.

(2) The sintered body filters 110 to 190 can be easily made compact, can be easily prevented from coming off, and can be easily and securely loaded in the middle of the pipe passage or the valve apparatus.

(3) Since the sintered body filters 150, 160, 170, 180 and 190 are provided with the ring bodies 151, 161, 171, 181 and 191 in the periphery of the filter main bodies 152, 162, 172, 182 and 192, they can be press-inserted and fixed to the middle of the pipe passage or the loaded portion of the valve apparatus. It is not necessary that the disassembly preventing means is independently provided.

(4) Since the sintered body filters 110 to 140 are directly loaded in the switching valve apparatus 50, it is possible to securely protect the switching valve apparatus 50.

(5) Since the sintered body filters 150 and 160 are loaded in the relief valves of the up-blow valve 80 and the down-blow valve 90, it is possible to securely protect the relief valves.

(6) Since the sintered body filter 190 is loaded in the gear pump 21, it is possible to securely protect the gear pump 21.

While the preferred embodiments of the invention have been described in detail with reference to the drawings, they are by no means limitative, and various changes and modifications are possible without departing from the scope and spirit of the invention. For example, the shape of the engaging portion provided on the spring seat for fitting and fixing the cover-receiver is not limited to the recessed shape, and the engaging portion has a projection. The dust cover receiving structure of the shock absorber of the invention is not limited to be applied to a hydraulic shock absorber, and may be applied to various shock absorbers.

In accordance with the invention, in the power tilt apparatus, it is possible to easily and securely load the filter in the middle of the pipe passage. It is also possible to securely protect the valve apparatus and the like from foreign particles generated in the middle of the pipe passage.

Although the invention has been illustrated and described with respect to several exemplary embodiments thereof, it should be understood by those skilled in the art that the foregoing and various other changes, omissions and additions may be made to the present invention without departing from the spirit and scope thereof. Therefore, the present invention should not be understood as limited to the specific embodiment set out above, but should be understood to include all possible embodiments which can be embodied within a scope encompassed and equivalents thereof with respect to the features set out in the appended claims.

What is claimed is:

1. A power tilt apparatus, comprising a cylinder apparatus switchable between an extension side and a compression side in accordance with an oil feeding direction of a pump apparatus, and a switching valve apparatus provided in a pipe passage connecting the cylinder apparatus and the pump apparatus for switching the cylinder apparatus, a sintered body filter being provided in the middle of the pipe passage, wherein the sintered body filter is loaded in the switching valve apparatus.

2. A power tilt apparatus, comprising a cylinder apparatus switchable between an extension side and a compression side in accordance with an oil feeding direction of a pump apparatus, and a switching valve apparatus provided in a pipe passage connecting the cylinder apparatus and the pump apparatus for switching the cylinder apparatus, a sintered body filter being provided in the middle of the pipe passage, the sintered body filter being formed by fitting a filter main body to a hollow portion of a ring body, wherein the sintered body filter is loaded in the switching valve apparatus.

3. A power tilt apparatus, comprising a cylinder apparatus switchable between an extension side and a compression side in accordance with an oil feeding direction of a pump apparatus, and a switching valve apparatus provided in a pipe passage connecting the cylinder apparatus and the pump apparatus for switching the cylinder apparatus, a sintered body filter being provided in the middle of the pipe passage, wherein the sintered body filter is loaded in the pump apparatus.

4. A power tilt apparatus, comprising a cylinder apparatus switchable between an extension side and a compression side in accordance with an oil feeding direction of a pump apparatus, and a switching valve apparatus provided in a pipe passage connecting the cylinder apparatus and the pump apparatus for switching the cylinder apparatus, a sintered body filter being provided in the middle of the pipe passage, the sintered body filter being formed by fitting a filter main body to a hollow portion of ring body, wherein the sintered body filter is loaded in the pump apparatus.

5. A power tilt apparatus, comprising a cylinder apparatus switchable between an extension side and a compression side in accordance with an oil feeding direction of a pump apparatus, and a switching valve apparatus provided in a pipe passage connecting the cylinder apparatus and the pump apparatus for switching the cylinder apparatus, a sintered body filter being provided in the middle of the pipe passage, the sintered body filter being formed by fitting a filter main body to a hollow portion of a ring body, wherein the sintered body filter comprises a filter main body fitted to a hollow portion of a ring body and caulked to both end portions of the ring body to inner diameter sides, thereby fixing the filter main body to an inner portion of the ring body in a disassembly prevention state.

6. A power tilt apparatus, comprising a cylinder apparatus switchable between an extension side and a compression side in accordance with an oil feeding direction of a pump apparatus, and a switching valve apparatus provided in a pipe passage connecting the cylinder apparatus and the pump apparatus for switching the cylinder apparatus, a sintered body filter being provided in the middle of the pipe passage, the sintered body filter being formed by fitting a filter main body to a hollow portion of a ring body, wherein the sintered body filter comprises a ring body having a large-diameter ring portion and a small-diameter ring portion, a filter main body being fixed to an inner portion of the large-diameter ring portion in a disassembly prevention state by fitting the filter main body to a hollow portion of the large-diameter ring portion and caulking an outer end portion of the large-diameter ring portion to an inner diameter side.

7. A power tilt apparatus as claimed in claim 6, wherein the filter main body is formed in a closed-end tubular shape.

* * * * *